United States Patent [19]

Beaver et al.

[11] 4,093,533

[45] June 6, 1978

[54] BONDED ASBESTOS DIAPHRAGMS

[75] Inventors: Richard N. Beaver; Charles W. Becker, both of Angleton, Tex.

[73] Assignee: The Dow Chemical Company, Midland, Mich.

[21] Appl. No.: 640,119

[22] Filed: Dec. 12, 1975

[51] Int. Cl.[2] ..... C25B 13/02; C25B 13/06; C25B 13/08

[52] U.S. Cl. ..... 204/296; 204/295; 204/98

[58] Field of Search ..... 204/295, 296; 162/155, 162/169

[56] References Cited

U.S. PATENT DOCUMENTS

| | | | |
|---|---|---|---|
| 3,505,200 | 4/1970 | Grotheer | 204/295 |
| 3,723,264 | 3/1973 | Leduc et al. | 204/80 |
| 3,853,721 | 12/1974 | Darlington et al. | 204/98 |
| 3,928,166 | 12/1975 | O'Leary et al. | 204/282 |
| 3,945,910 | 3/1976 | DeCeuster et al. | 204/296 |
| 3,980,613 | 9/1976 | Bachot et al. | 264/45.3 |
| 4,000,057 | 12/1976 | Mrazek et al. | 204/296 |

*Primary Examiner*—F.C. Edmundson
*Attorney, Agent, or Firm*—Walter J. Lee

[57] ABSTRACT

Improved asbestos diaphragms for use in electrolytic chlor-alkali cells are prepared by using polymeric fluorocarbons as binders for mixtures of chyrsotile asbestos and crocidolite asbestos.

6 Claims, No Drawings

BONDED ASBESTOS DIAPHRAGMS

BACKGROUND OF THE INVENTION

The use of asbestos as diaphragm material in electrolytic chlor-alkali cells is well known. Ordinarily the diaphragms are prepared by vacuum-drawing a slurry of chrysotile asbestos fibers onto a porous cathode, thereby depositing a matte of asbestos on the cathode.

It has been previously taught that polymeric fluorocarbons may be used as binders for asbestos diaphragms. The most relevant technique taught is, in general, to mix a slurry of particulate binder material with the asbestos fibers, then draw or deposit the materials in the form of a matte on the porous cathode, then heat-sinter to effect bonding. Patents which teach the use of binders of polymers for use in asbestos diaphragms are, for example as follows:

- U.S. Pat. No. 1,942,183 — teaches use of organic glutinous material as binder for asbestos diaphragms.
- U.S. Pat. No. 2,731,068 — teaches impregnation of asbestos fabric with dispersion of polytetrafluoroethylene, followed by heat-sintering.
- U.S. Pat. No. 2,840,881 — teaches non-woven asbestos batt having superposed thereon a non-woven batt of polytetrafluoroethylene.
- U.S. Pat. No. 2,944,956 — teaches use of the polytetrafluoroethylene (and polymonochlorotrifluoroethylene) screen along with asbestos diaphragm.
- U.S. Pat. No. 2,945,831 — teaches mixing of fluorocarbon dispersions (and other polymers) with dispersion of asbestos, then forming a crack-free coalesced film on a substrate.
- U.S. Pat. No. 3,017,338 — teaches polymer-bonded asbestos diaphragms and membranes.
- U.S. Pat. No. 3,097,990 — teaches, among other things, use of polytetrafluoroethylene dispersions to certain pre-treated asbestos sheets.
- U.S. Pat. No. 3,153,610 — teaches preparation of asbestos paper from an aqueous blend of asbestos particles and polymer particles, the polymer being of "ethylenically unsaturated compounds".
- U.S. Pat. No. 3,551,205 — teaches addition of polytetrafluoroethylene aqueous emulsion to an asbestos slurry to prepare bonded web for use as a "paper" electrode structure in a voltaic cell.

Other patents which teach the use of fluorocarbon polymers as binders for asbestos in preparing diaphragms or membranes for use in electrolytic cells are, e.g.: U.S. Pat. No. 3,583,891; U.S. Pat. No. 3,694,281; U.S. Pat. No. 3,704,221; and U.S. Pat. No. 3,723,264. These four patents teach mixing of fluorocarbon polymer dispersions with asbestos fibers prior to forming the diaphragm.

SUMMARY OF THE INVENTION

It has now been found that asbestos diaphragms for use in electrolytic cells, especially chlor-alkali cells, which are prepared by using a fluorocarbon polymer as a binder, are improved by employing certain mixtures of chrysotile asbestos and crocidolite asbestos.

DETAILED DESCRIPTION OF THE INVENTION

In the present invention, fibers of chrysotile asbestos and crocidolite asbestos are combined in aqueous slurry with particulate fluorocarbon polymers and the resulting slurry is deposited on a porous cathodic substrate.

The chrysotile fibers and the crocidolite fibers are preferably about ¼ inch or more in length and the fiber bundles, as normally mined, have been refined to open up the bundles. Commercially available refined asbestos is suitable for use in the present invention.

The fluorocarbon polymers may be solid, particulate polymers or copolymers of tetrafluoroethylene, trifluoroethylene, vinylidene fluoride, vinyl fluoride, monochlorotrifluoroethylene, or dichlorodifluoroethylene or may be fluorinated ethylene/propylene copolymer commonly known as FEP. Also, a copolymer of ethylene/chlorotrifluoroethylene known as Halar® may be used. Preferably the fluorocarbon polymer is polyvinylidene fluoride, fluorinated ethylene/propylene copolymer, or polytetrafluoroethylene. Most preferably, the fluorocarbon polymer is polyvinylidene fluoride.

The ratio of chrysotile/crocidolite is in the range of about 90/10 to 20/80, preferably in the range of about 75/25 to about 40/60, most preferably the ratio is about 50/50.

The asbestos slurry may also contain minor amounts of processing aids such as surfactants, wetting agents, or dispersing agents, or modifiers, such as pH-adjusters, inorganic metal compounds, e.g. $TiO_2$, $CaCO_3$, $MgCO_3$, MgO, CaO, etc. Such processing aids or modifiers may be employed in order to help disperse the fluorocarbon polymer and the asbestos fibers uniformly in the aqueous medium and to impart certain porosity features to the diaphragm.

The fluorocarbon polymer aqueous slurries or dispersions may be commercially available and generally contain such processing aids or modifiers as stabilizers, surfactants, dispersing agents, etc. Such polymer dispersions may also be prepared for use in the present invention by dispersing fine particle polymer in an aqueous medium by using wetting agents, surfactants, dispersing agents, or stabilizers which help to disperse the fluorocarbon polymers and/or stabilize such dispersions.

The asbestos and fluorocarbon polymer slurry is preferably deposited on the desired porous cathode structure by being vacuum-drawn. By vacuum-drawn it is meant that a slurry of the diaphragm ingredients (asbestos, polymer, modifiers, etc.) is contacted with one side of a porous cathode and "vacuum" (reduced pressure) is applied to the other side to pull the solids tightly into place against the cathode while pulling the liquid on through.

Other methods of depositing the diaphragm onto the cathode include the use of gravity flow or positive pressure to force the dispersion against a porous surface, thereby depositing the solids in the form of a matte or web while the liquid flows on through the porous surface. The matte or web of diaphragm material may be prepared on a surface other than the cathode surface (such as by using a Fourdrinier process) and then transferred to the cathode surface.

It is generally recognized in the art that chlorine cell diaphragms made of chrysotile asbestos have relatively poor resistance to low anolyte pH. Chrysotile asbestos fibers are relatively easily bonded together with polymeric fluorocarbons. Crocidolite asbestos fibers alone have good resistance to highly acid (i.e. low pH) anolyte but are not readily bonded together with polymeric fluorocarbons to form a strong diaphragm. Thus, attempts to completely substitute acid-resistant crocidolite in place of chrysotile in polymer-bonded diaphragms have not been successful.

According to the present invention, the acid-resistance of crocidolite and the bondability of chrysotile are made available in a diaphragm which employs both forms of asbestos. A blended composite of crocidolite and chrysotile asbestos, bonded with polymeric fluorocarbon, is found to be extremely stable in anolytes having a pH as low as about 0.5. By being able to operate at a low anolyte pH of about 0.5 to about 1.5, the life of graphite anodes is extended and graphite consumption per ton of chlorine produced is substantially decreased. Furthermore, the lower anolyte pH also increases chlorine purity from the cells as the production of other electrolytic products such as oxygen, carbon dioxide, and carbon monoxide is substantially inhibited. Chlorine producers are aware that an anolyte pH lower than about 1.5 will acidize the normally-used chrysotile asbestos and result in its early destruction, therefore it has been common practice to operate at an anolyte pH of not lower than 1.5 in order to obtain appreciable life of the diaphragm, even though some sacrifice of the graphite anode life is encountered.

The following procedures and examples are illustrative of the present invention, except for those identified as being "comparative". Other embodiments of the present invention will become apparent to practitioners of the art and the present invention is limited only by the claims attached hereto.

In general, the preferred method of preparing the present diaphragms for use in an electrolytic process wherein an aqueous NaCl solution is electrolyzed to produce chlorine, hydrogen, and sodium hydroxide is as follows:

1. The crocidolite fibers, chrysotile fibers, and fine particle size polymeric fluorocarbon are intimately admixed and slurried in an aqueous media. The aqueous slurry also contains any modifiers, surfactants, etc. which are desired. The amount of fluorocarbon polymer employed may be from about 5 parts to about 100 parts per hundred parts of total asbestos; the preferred amount is about 10 to 50 parts with about 15–40 parts being most preferred.

2. The slurried ingredients are deposited on the foraminous cathode to the desired weight generally about 0.2 gms. to about 2.0 gms. per in.$^2$, and dried. Preferably, the weight is about 0.6 to about 0.8 gms./in$^2$.

3. The so-coated cathode is subjected to a sufficient amount of heat to cause sintering of the polymer particles in the mixture; pressure may be applied, if desired, either by placing a positive force against the diaphragm or by using a vacuum (reduced pressure) on the other side of the foraminous cathode which will draw the diaphragm tightly against the cathode during the sintering operation. The amount of heat will depend, to a large extent, on which polymeric fluorocarbon is being used; the sintering temperature (or softening temperature ) of the desired polymer is easily determined experimentally or is available in the publications.

4. The diaphragm-covered cathode is placed into position in the electrolytic cell and, in some cases, is "pre-wetted" by being soaked with a water-soluble wetting agent, such as, detergent, surfactant, methanol, or acetone to make the diaphragm less hydrophobic. Then it is generally flushed with water, anolyte, or brine after which the cell is filled with brine and is ready for the electrolytic process to begin. The "pre-wetting" is done for those polymeric fluorocarbons which exhibit a high degree of hydrophobicity or resistance to wetting, such as polytetrafluroroethylene.

In those cases in which relatively low bonding temperatures may be used, wetting agents present in the pregnant slurry may survive the bonding without appreciable degradation and may therefore aid in the initial "wetting-out" of the diaphragm when put into service in a chlor-alkali cell. When relatively high bonding temperatures are needed, such as with polytetrafluoroethylene, surfactants in the pregnant slurry may be thermally degraded and it may be advisable to employ a wetting agent or a "wetting-out" step for the diaphragm at the outset of its service in a chlor-alkali cell.

The electrolytic cell is the diaphragm type commonly used for electrolysis of brine to produce chlorine, caustic, and hydrogen. Historically, the diaphragm has been made of asbestos, the anode has been made of graphite, and the cathode has been made of iron or steel. The diaphragm is positioned between the cathode and the anode and electric current flows through the electrolyte (brine). The porosity of the diaphragm is important in that there must be some water-permeability without having so much permeability that the caustic in the catholyte flows freely into the anolyte. It is within the skill of practitioners of the chlorine cell art to adjust the porosity of the asbestos diaphragms to obtain optimum results for their particular operation.

EXAMPLE 1

A diaphragm was prepared for use in a test cell as follows:

A dispersion of polyvinylidene (Kynar®) powder was prepared by mixing, in a Waring blender, 80 gms. of Kynar®, 250 ml. of $H_2O$, and 8 ml. of a non-ionic surfactant (alkyl aryl polyether alcohol + about 20% isopropanol).

Crocidolite asbestos (Type 713 from the North American Asbestos Company) was mixed at 0.5 pounds per gallon of water and vigorously agitated for about 5 minutes in a Cowles Dissolver.

Chrysotile asbestos (Plastibest from Johns Manville) was mixed at 0.5 pounds per gallon of water and vigorously agitated for about 5 minutes in a Cowles Dissolver.

Equal portions of the asbestos dispersions were mixed together and diluted with water to give a slurry containing 10 gms. per liter of asbestos with equal parts of chrysotile and crocidolite.

A volume of the slurry, sufficient to give 21 gms. of asbestos, was thoroughly blended with a portion of the Kynar slurry, sufficient to give 3.15 gms. of Kynar.

The resulting slurry was substantially uniformally deposited onto a 13-gauge, 33 in.$^2$, perforated steel plate cathode by vacuum-filtration. Thus, the deposited materials was in an amount of about 0.73 gms./in.$^2$ The so-coated cathode was placed in a 180° C oven for 3 hours to effect bonding.

After being cooled, the diaphragm was subjected to a stream of water and it was found that the fibers remained adhered in place and none washed off. Non-bonded diaphragms are easily washed off by a stream of water.

The diaphragm-covered cathode was installed in a small laboratory test chlorine cell used to evaluate diaphragm integrity and operability. After 4 days of operation at a pH in the range of 1.0–1.5 the cell was found to be performing excellently. For comparison purposes, another diaphragm was prepared the same way except that no binder was used; this non-bonded diaphragm had to be removed from service after 18 hours of operation because of disintegration which caused some fibers to wash off the cathode, stop circulation, and cause hot spots which resulted in the cell boiling and a high voltage drop across the cell.

are employed in preparing diaphragms on steel cathodes and tested in a chlor-alkali cell where aqueous NaCl is electrolyzed to produce chlorine, caustic, and hydrogen. Table I summarizes the data and results. All samples are tested at a pH of less than 1.5 to determine resistance to degradation in the acid environment of the anolyte.

TABLE I

| Run No. | Asbestos used % Crocidolite | Asbestos used % Chrysotile | Parts of polymeric fluorocarbon polymer used per 100 parts total asbestos: Parts | Identity | Bonded Conditions °C temp. | min. time | Resistance to Acid Degradation | Operability Rating and Remarks |
|---|---|---|---|---|---|---|---|---|
| 3 | 50 | 50 | 5 | Kynar ®-Grade 451 | 180 | 180 | Good | Better than non-bonded |
| 4 | 50 | 50 | 7.5 | " | " | " | Good | Better than non-bonded |
| 5 | 50 | 50 | 10 | " | " | " | Very Good | Better than 5% bonded |
| 6 | 50 | 50 | 15 | " | " | " | Excellent | Good wet-out, very good operation |
| 7 | 50 | 50 | 20 | " | " | " | Excellent | " |
| 8 | 50 | 50 | 30 | " | " | " | Excellent | " |
| 9 | 50 | 50 | 40 | " | " | " | Excellent | Fair wet-out, very good operation |
| 10 | 50 | 50 | 75 | " | " | " | Excellent | Poor wet-out, fair operation |
| 11* | 100 | 0 | 15 | " | " | " | Excellent | Poor bonding, short life |
| 12* | 0 | 100 | 15 | " | " | " | Very Poor | Degrades rapidly |
| 13 | 67 | 33 | 50 | FEP | 316 | 19 | Excellent | Excellent operation, difficult to wet |
| 14 | 50 | 50 | 5 | FEP | 316 | 18 | Excellent | Very good operation, good wet-out |
| 15 | 50 | 50 | 25 | FEP | 320 | 13 | Excellent | Excellent operation, good wet-out |
| 16 | 50 | 50 | 72 | Kynar ®-Grade 451 | 182 | 15 | Excellent | Difficult to wet, but once wetted out, has very good operation |
| 17* | 0 | 100 | 0 | — | — | — | Very Poor | Degrades rapidly |
| 18* | 0 | 100 | 18 | Kynar ®-Grade 451 | 182 | 15 | Poor | Degrades rapidly, but lasts longer than with no binder |
| 19 | 75 | 25 | 18 | Kynar ®-Grade 451 | 182 | 15 | Excellent | Wets easily, very good operation |
| 20 | 25 | 75 | 20 | Kynar ®-Grade 451 | 182 | 15 | Fair | Wets easily, good operation |
| 21 | 33 | 67 | 20 | Kynar ®-Grade 451 | 182 | 15 | Very Good | Wets easily, good operation |

*Comparative examples, not examples of the invention.

EXAMPLE 2

In a manner substantially as shown in Example 1 above, polytetrafluoroethylene (Teflon ®) powder is employed as a bonding agent for a 50/50 mixture of crocidolite and chrysotile. There are commercially available Teflon ® dispersions which are suitable for use directly in this process. In this example, micron size Teflon ® available in a spray can is employed. Also in this example, $TiO_2$ is also mixed into the asbestos to aid in the wetting (since Teflon ® resists wetting) and to impart greater permeability. The bonding is effected by placing the vacuum-deposited diaphragm in a 300°–400° C oven for about 4–8 minutes under a nitrogen atmosphere.

The diaphragm-covered cathode is placed in the chlor-alkali test cell and pre-wetted with methanol, then flushed with water, thereby decreasing the hydrophobicity of the diaphragm. The test cell is operated at a pH in the range of about 1.0–1.5 pH and the diaphragm is found to resist disintegration at this low pH and has substantially longer life and greater operability than non-bonded asbestos diaphragms.

EXAMPLES 3–21

Following the procedure, generally, as set forth above, various mixtures of chrysotile and crocidolite and various amounts of polymeric fluorocarbon binders

We claim:

1. An improved diaphragm for use in an electrolytic cell wherein brine is electrolyzed to produce chlorine, caustic, and hydrogen and wherein a polymeric fluorocarbon-bonded asbestos diaphragm is positioned between the electrodes, the improvement which comprises the use of a mixture of crocidolite and chrysotile as the asbestos, said mixtures of crocidolite/chrysotile being of a weight ratio in the range of about 33/67 to about 75/25.

2. The improved diaphragm of claim 1 wherein the weight ratio of crocidolite/chrysolite is about 50/50.

3. The improved diaphragm of claim 1 wherein the polymeric fluorocarbon employed in the polymeric fluorocarbon-bonded diaphragm is selected from the group consisting of polymers and copolymers of tetrafluoroethylene, trifluoroethylene, monochlorotrifluoroethylene, dichlorodifluoroethylene, vinyl fluoride, vinylidene fluoride, and fluorinated olefin polymers.

4. The improved diaphragm of claim 1 wherein the polymeric fluorocarbon is polyvinylidene fluoride.

5. The improved diaphragm of claim 1 wherein the polymeric fluorocarbon is polytetrafluoroethylene.

6. The improved diaphragm of claim 1 wherein the polymeric fluorocarbon is fluorinated ethylene/propylene copolymer.

* * * * *

UNITED STATES PATENT AND TRADEMARK OFFICE

CERTIFICATE OF CORRECTION

PATENT NO. : 4,093,533

DATED : June 6, 1978

INVENTOR(S) : Richard N. Beaver, et al

It is certified that error appears in the above-identified patent and that said Letters Patent are hereby corrected as shown below:

In the Abstract, correct "chyrsotile" to ---chrysotile---.

Col. 1, line 16, after "binders" correct "of" to ---or---.

Col. 1, line 28, after "teaches use of", delete "the".

Col. 4, line 2, correct "polytetrafluroroethylene" to ---polytetrafluoroethylene---.

Col. 4, line 32, after "polyvinylidene" insert ---fluoride---.

Col. 4, line 55, correct "terials" to ---terial---.

Col. 6, line 42, correct "mixtures" to ---mixture---.

Col. 6, line 46, correct "chrysolite" to ---chrysotile---.

Signed and Sealed this

*Second* Day of *January 1979*

[SEAL]

*Attest:*

RUTH C. MASON
*Attesting Officer*

DONALD W. BANNER
*Commissioner of Patents and Trademarks*